US006443562B1

(12) United States Patent
Yoon

(10) Patent No.: US 6,443,562 B1
(45) Date of Patent: Sep. 3, 2002

(54) INTEGRALLY FORMED DRIVING MODULE FOR AN INK JET APPARATUS AND METHOD FOR MANUFACTURING IT

(75) Inventor: Yong-Seop Yoon, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 41 days.

(21) Appl. No.: 09/645,550

(22) Filed: Aug. 25, 2000

(30) Foreign Application Priority Data

Nov. 4, 1999 (KR) ..... 99-48546

(51) Int. Cl.[7] ..... B41J 2/05
(52) U.S. Cl. ..... 347/63
(58) Field of Search ..... 347/63, 56, 64, 347/61, 54; 216/27, 4, 48; 29/840.1; 430/311

(56) References Cited

U.S. PATENT DOCUMENTS 5,870,121 A * 2/1999 Chan ..... 347/63

* cited by examiner

*Primary Examiner*—Raquel Yvette Gordon
(74) *Attorney, Agent, or Firm*—Robert E. Bushnell, Esq.

(57) ABSTRACT

A method for manufacturing a driving module of an ink jet apparatus. The driving module is manufactured by the steps of: forming a working fluid chamber etching a wafer, vapor-depositing a low electrode in the working fluid chamber, attaching a polyamide sheet on the wafer, forming a membrane etching of the polyamide sheet, and vapor-depositing an upper electrode on the membrane. The working fluid chamber is formed by a wet etching process, while the membrane is formed by a dry etching process. Since the membrane is manufactured together with the driving module, no additional processes for separately making the membrane are required, and accordingly, a process for attaching the membrane is not required. Further, there is no waste of wafers and other materials for making the membrane, and the membrane is made to be appropriately thin, thus the ink jet apparatus is driven efficiently even with low potential difference.

10 Claims, 6 Drawing Sheets

INTEGRALLY FORMED DRIVING MODULE FOR AN INK JET APPARATUS AND METHOD FOR MANUFACTURING IT

CLAIM OF PRIORITY

This application makes reference to, incorporates the same herein, and claims all benefits accruing under 35 U.S.C. § 119 from the inventor's application METHOD FOR MANUFACTURING A DRIVING PART OF AN INK JETTING APPARATUS filed with the Korean Industrial Property Office on Nov. 4, 1999 and there duly assigned Ser. No. 48546/1999.

BACKGROUND OF THE INVENTION

1. Field of the Invention

The present invention relates to an ink jet apparatus, such as an inkjet printer or a facsimile machine. More particularly, the invention concerns an integrally formed driving module of an electrostatic attraction type inkjet apparatus, and a method for manufacturing the module.

2. Description of the Related Art

Generally, an ink jet apparatus is employed in a print head of an output device, such as an inkjet printer or and a facsimile machine. The apparatus forces a jet of ink from an ink chamber through a nozzle. Such fluid jet apparatus types include a thermal type, an electrostatic-attraction type, a piezoelectric type, and a thermo-compression type, the type depending on the method for applying physical force to the fluid.

An example of an electrostatic attraction type fluid jet apparatus is shown in FIG. 1. The fluid jet apparatus includes a driving module 20 and a nozzle module 40.

Driving module 20 includes a substrate 15, an oxide layer 14 laminated on substrate 15, a working fluid barrier 25 having a working fluid chamber 27, a lower electrode 17 disposed in working fluid chamber 27, a membrane 30 disposed on the upper portion of working fluid chamber 27, and an upper electrode 37 disposed on the upper portion of membrane 30. Working fluid chamber 27 is either kept in a vacuum state, or is filled with a working fluid having a high permittivity, to accelerate the generation of the electrostatic force which will be described below.

Nozzle module 40 includes an ink chamber barrier 45 having an ink chamber 57, and a nozzle plate 47 connected to the upper portion of ink chamber barrier 45. On the upper side of nozzle plate 47, a nozzle 49 is formed to permit the ink in ink chamber 57 to be forced therethrough. The ink is constantly supplied to ink chamber 57 from an ink supply (not shown in the drawings).

As the voltage is applied to upper and lower electrodes 37 and 17, a potential difference is generated between upper and lower electrodes 37 and 17. Membrane 30 is deformed toward the working fluid chamber 27. The force deforming the membrane 30 is obtained by the following formula:

$$F=eAV^2/2D^2$$

where e is the permittivity of the working fluid reserved in working fluid chamber 27, A is the area of upper electrode 37, V is the potential difference between upper and lower electrodes 37 and 17, and D is the distance between upper and lower electrodes 37 and 17.

Membrane 30 lowers pressure in ink chamber 57, causing the ink to be sucked into ink chamber 57 from the ink supply (not shown). When the application of the voltage ceases, membrane 30 recovers its initial state. Accordingly, pressure in ink chamber 57 then increases, so that the ink in ink chamber 57 is forced out through nozzle 49.

The driving module 20 of the above-described electrostatic attraction type ink jet apparatus is made by the following processes: FIGS. 2 to 9 show the manufacturing processes for driving module 20 of a conventional electrostatic attraction type ink jet apparatus. The method for manufacturing driving module 20 includes the steps of making membrane 30 and various other modules, separately, and then connecting separately made membrane 30 and the other modules.

Membrane 30 is made by the following processes: As shown in FIG. 2, membrane 30 of a polyamide material is applied on substrate 60 by a spin coater. An oxide layer 61 is then vapor-deposited on substrate 60. Then, as shown in FIG. 3, an O-ring 63 made of quartz glass is attached to membrane 30. Then, as shown in FIG. 4, substrate 30 and oxide layer 61 are separated from membrane 30.

Working fluid barrier 25 is made by the following processes: As shown in FIG. 5, a lower electrode 17 is formed on a substrate 15 by a photo etching process. Then, an oxide layer 14 is vapor-deposited on substrate 15. Then, as shown in FIG. 6, working fluid barrier 25 is made as the polyamide is applied on oxide layer 14 by the spin coater, and then the central portion thereof is etched by a photo etching process.

When working fluid barrier 25 is completed, as shown in FIG. 7, membrane 30 shown in FIG. 4 is attached to the upper portion of working fluid barrier 25. Membrane 30 is then turned over so that O-ring 63 is located at a lower position. Then, as shown in FIG. 8, O-ring 63 is removed, and an upper electrode 37 is vapor-deposited on membrane 30 as shown in FIG. 9. As a result, driving module 30 is completed. After that, nozzle module 40, which is obtained through a separate manufacturing process, is attached to driving module 30. That completes a conventional electrostatic attraction type ink jet apparatus.

The above-described conventional ink jet apparatus, however, has the following shortcoming. The membrane 30 is separately made from the other modules, and it takes several processes to complete membrane 30, such as attaching O-ring 63, and separating the substrate 60. Accordingly, additional processes are needed for attaching membrane 30 to working fluid barrier 25. Also, an additional wafer is needed to manufacture membrane 30.

In order to overcome the shortcoming of the conventional ink jet apparatus, another electrostatic attraction type inkjet apparatus has been suggested in which ink chamber barrier 45 of nozzle module 40 is integrally formed with membrane 30 during the manufacturing of nozzle module 40. Such an ink jet apparatus saves manufacturing processes since ink chamber barrier 45 and membrane 30 are integrally formed (i.e., as a unitary product) by one process. Such an inkjet apparatus employs a method of doping the area corresponding to the membrane to provide conductivity, however, because it is hard to make upper electrode 37 to generate an electrostatic attraction with lower electrode 17.

This suggested ink jet apparatus, however, has a further shortcoming in that it is difficult to maintain a fine gap between lower electrode 17 and membrane 30. According to the above-mentioned formula ($F=eAV^2/2D^2$), the electrostatic attraction is increased as the gap between lower and upper electrodes 17 and 37 is narrowed. In the above ink jet apparatus, however, the gap between lower and upper electrodes 17 and 37 is relatively large, so a higher potential difference is needed to generate an appropriate electrostatic attraction for deformation of membrane 30. Moreover, it is difficult to make thin membrane 30. Accordingly, higher force is required to deform the membrane 30, and thus the product requires a higher degree of electrostatic attraction.

SUMMARY OF THE INVENTION

It is an object of the present invention to provide an improved method for manufacturing a driving module for an electrostatic attraction type ink jet apparatus. The method of this invention makes membrane integral with a driving module. The membrane is not made separately. The resulting membrane is capable of generating electrostatic attraction efficiently, and performing a smooth jet operation.

The improved method for manufacturing a driving module of an ink jet apparatus includes the steps of: forming a working fluid chamber by etching a wafer; vapor-depositing a lower electrode in the working fluid chamber; attaching a polyamide sheet to the wafer; forming a membrane by etching the polyamide sheet; and vapor-depositing an upper electrode on the membrane. The working fluid chamber is formed by a wet etching process, and the membrane is formed by a dry etching process.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components.

DETAILED DESCRIPTION OF PREFERRED EMBODIMENTS

Figure 1:
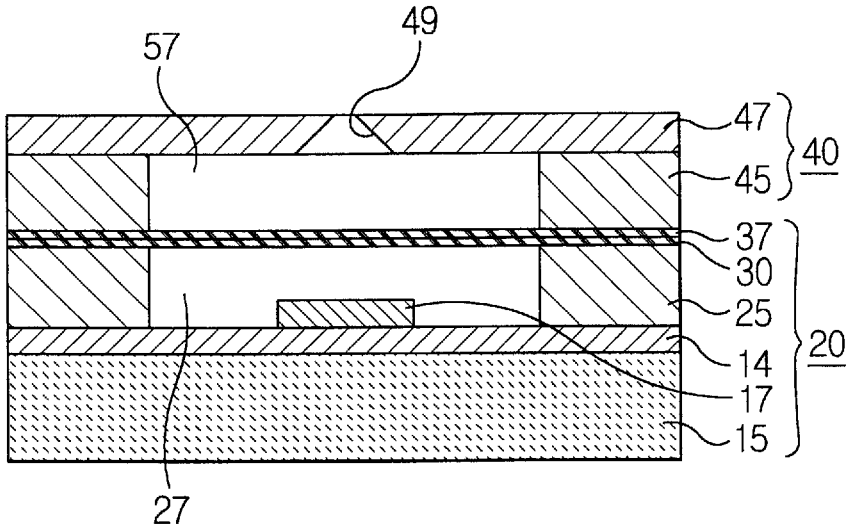
FIG. 1 (PRIOR ART)
FIG. 1 is a sectional view of a conventional electrostatic attraction type ink jet apparatus of the prior art.
Figure 2:
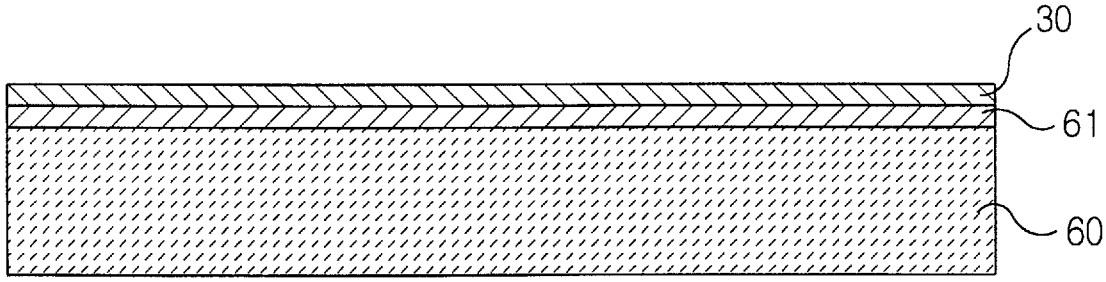
FIGS. 2 to 9 are views for illustrating the manufacturing processes for the prior art ink jet apparatus shown in FIG. 1, in a sequential manner.
Figure 3:
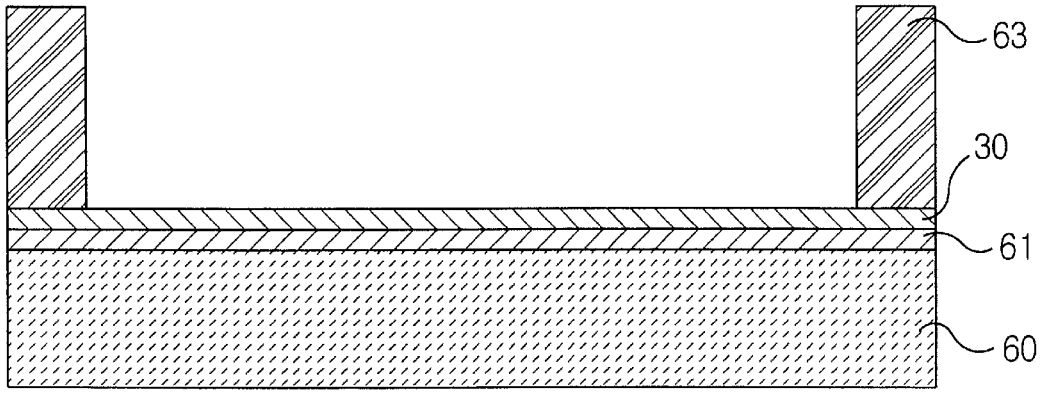
Figure 4:
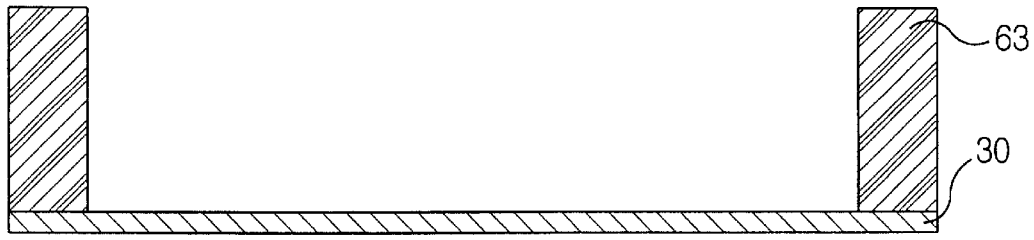
Figure 5:
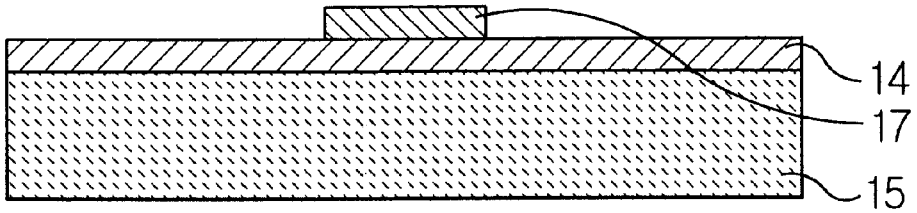
Figure 6:
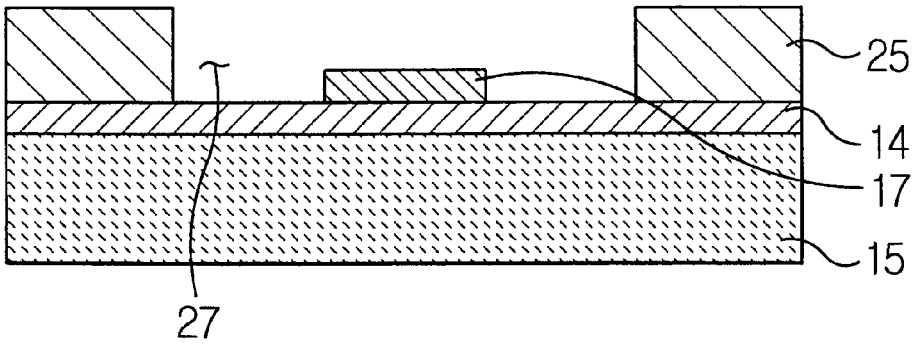
Figure 7:
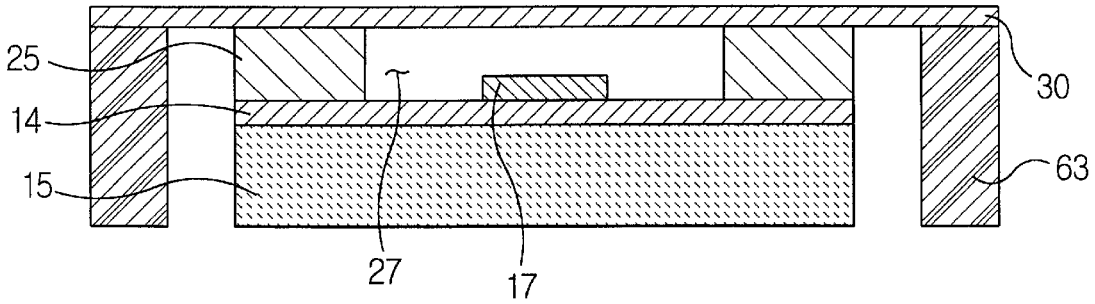
Figure 8:
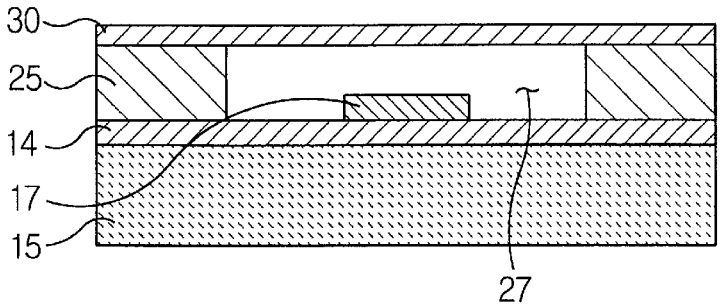
Figure 9:
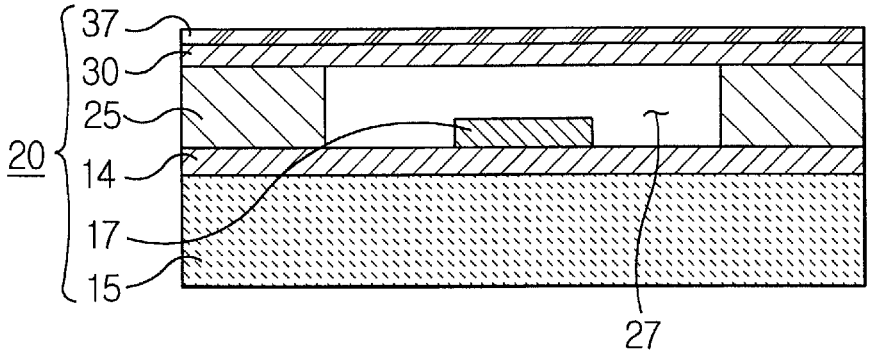

Reference will now be made in detail to the present preferred embodiment of the present invention, examples of which are illustrated in the accompanying drawings, wherein like reference numerals refer to like elements throughout. Also, since the structure of a nozzle module is identical with that of the conventional ink jet apparatus shown in FIG. 1, repetitious descriptions thereof will be omitted.

FIGS. 10 to 14 are views for illustrating the manufacturing processes of an ink jet apparatus according to the present invention in a sequential manner.

Figure 10:
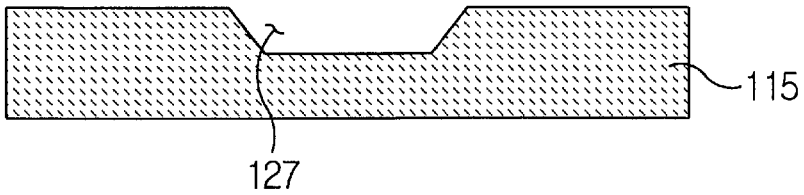
FIGS. 10 to 14 are views for illustrating the manufacturing processes for an ink jet apparatus according to the present invention in a sequential manner.

First, as shown in FIG. 10, a working fluid chamber 127 is formed by etching a wafer 115. More specifically, working fluid chamber 127 is formed through the processes of silicon nitride masking, and then wet etching the corresponding area except for the area where working fluid chamber 127 is to be formed. The depth of the wet etching is adjusted by conventionally adjusting the etching time and the density of the etching solution. Further, it is preferable to use a wafer having an orientation of (100), so that a silicon wafer 115 can be slant-etched while being wet etched. Since the wafer having the orientation of (100) is etched at a constant slanted angle of 54.74° with respect to the horizontal surface during the wet etching process, it has a high Step Coverage when the metal is attached for electrode manufacturing.

Figure 11:
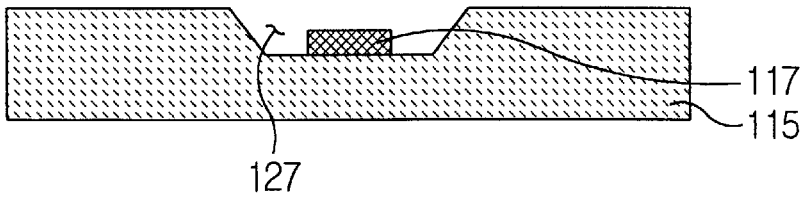
Figure 12:
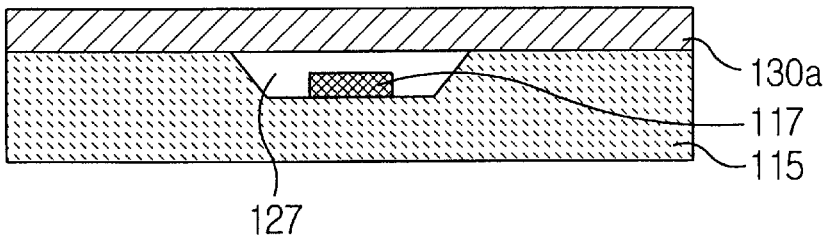

When working fluid chamber 127 is completed by the etching process, an insulating layer (not shown) is vapor-deposited on wafer 115. Lower electrode 117 is then vapor-deposited in working fluid chamber 127 by a conventional photo etching process, as shown in FIG. 11. Then, as shown in FIG. 12, a polyamide sheet 130*a* is attached by a lamination method.

Figure 13:
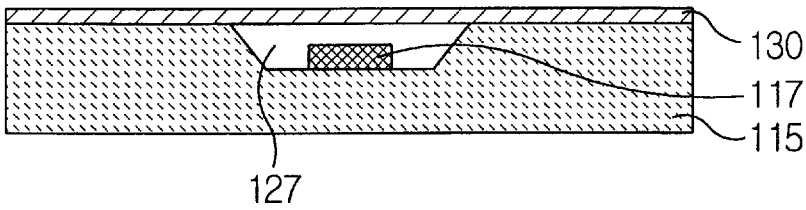

As polyamide sheet 130*a* is etched, membrane 130 is formed, as shown in FIG. 13. The thickness of membrane 130 should be several micrometers, to enable the smooth driving of membrane 130 even by a low voltage. By etching polyamide sheet 130*a*, which is several tens of micrometer thick, membrane 130 acquires the appropriate thickness for deformation is thereof during the generation of an electrostatic attraction. In this situation, polyamide sheet 130*a* is etched by a conventional dry etching process. Through the dry etching process, thickness of the membrane 130 is appropriately adjusted.

Figure 14:
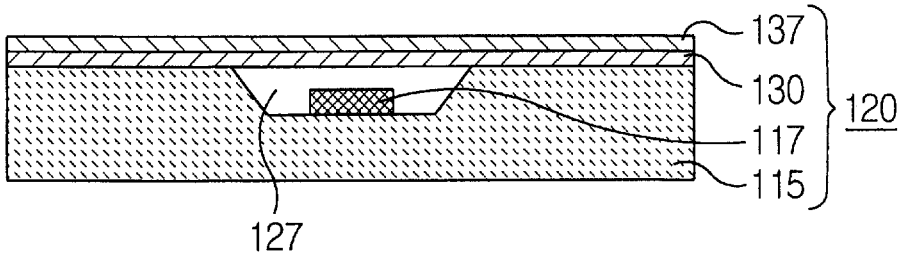

When membrane 130 is completed, as shown in FIG. 14, upper electrode 137 is vapor-deposited on membrane 130 by a conventional photo etching process. Accordingly, the driving module 120 of the ink jet apparatus is completed.

Then, nozzle module 40 shown in FIG. 1 is attached to completed driving module 120. Accordingly, the inkjet apparatus is completed. The operation of the inkjet apparatus made by the above-described process of the instant is comparable to that of the conventional ink jet apparatus described earlier with reference to FIG. 1. That is, membrane 130 is deformed by a potential difference between upper and lower electrodes 137 and 117, and the ink is forced through nozzle 49 when the potential difference is removed and membrane 130 recovers its initial shape.

As described above, according to the present invention, since membrane 130 is manufactured together with driving module 120, no additional processes for separately making membrane 130 are required. Accordingly, there is no need for any separate process to attach membrane 130. Further, there is no waste of wafers and other materials for making membrane 130, and membrane 130 can be appropriately thin, so that the operation of the ink jet apparatus is performed efficiently even with the low potential difference.

Although the preferred embodiment of the present invention has been shown and described, it will be appreciated by those skilled in the art that changes may be made in these embodiments without departing from the principles and spirit of the invention, the scope of which is defined in the claims and their equivalents.

What is claimed is:

1. A method for manufacturing a driving module of an ink jet apparatus, said method comprising the steps of:

(1) forming a working fluid chamber by etching a wafer;

(2) after the working fluid chamber is formed, vapor-depositing a lower electrode in the working fluid chamber;

(3) after the lower electrode is deposited, attaching a polyamide sheet to the wafer;

(4) after the polyamide sheet is attached to the wafer, forming a membrane having a thickness of several micrometers when completed, by etching the polyamide sheet; and (5) after the membrane is formed, vapor-depositing an upper electrode on the membrane, thereby completing fabrication of an ink jet apparatus driving module without a need for separate process steps for fabricating a separate membrane or for attaching the separate membrane to a partially completed driving module or for doping any area of the wafer corresponding to the membrane.

2. The method of claim 1, wherein the wafer-etching first step is performed by a wet etching process.

3. The method of claim 1, wherein the sheet-attaching third step is performed by a lamination method.

4. The method of claim 3, wherein the membrane-etching fourth step is performed by a dry etching process.

5. The product of the process of claim 1.

6. An integrally formed driving module for an ink jet apparatus, said module comprising a wafer in which a working fluid chamber is etched, a lower electrode vapor-deposited onto the working fluid chamber, a polyamide sheet laminated to the wafer, the sheet etched to form a membrane of a thickness of several micrometers, and an upper electrode vapor-deposited onto the membrane, said driving module fabricated such that it is free of dopants in and around an area thereof corresponding to the membrane.

7. The module of claim 6, wherein the fluid chamber is wet-etched.

8. The module of claim 6, wherein the membrane is dry-etched.

9. An integrally formed driving module for an inkjet apparatus, said module comprising a wafer in which a working fluid chamber is etched, a lower electrode vapor-deposited onto the working fluid chamber, a polyamide sheet laminated to the wafer, the sheet etched to form a membrane of a thickness of several micrometers, and an upper electrode vapor-deposited onto the membrane, said driving module fabricated entirely of passive elements.

10. In a process for manufacturing a driving module of an ink jet apparatus, said driving module without active elements, said method comprising steps of forming a working fluid chamber by etching a wafer; vapor-depositing a lower electrode in the working fluid chamber; causing a membrane to be superimposed over the lower electrode and attached thereto; and vapor-depositing an upper electrode over the membrane, the improvement comprising fabricating the membrane integrally with the driving module so that a membrane of a thickness of several micrometers is attached to the driving module without performing a step of attaching a separate membrane element to the driving module after the membrane element has been fabricated or of doping the wafer in an area thereof corresponding to the membrane.

* * * * *